United States Patent [19]

Kozhevnikov et al.

[11] 4,276,764

[45] Jul. 7, 1981

[54] DIE SET FOR SIZING SECTIONS

[76] Inventors: Vladislav A. Kozhevnikov, ulitsa Plekhanovskaya, 43, kv. 25; Ivan V. Kononov, ulitsa Torpedo, 40, kv. 4; Ivan E. Maslennikov, ulitsa Lizjukova, 43, kv. 57; Vladimir N. Platonov, ulitsa Lizjukova, 43, kv. 112, all of, Voronezh; Mikhail V. Kharitonovich, Chapaevsky pereulok, 12/1, kv. 69, Moscow, all of U.S.S.R.; deceased Viktor I. Ustinov, late of Moscow, U.S.S.R.; by Klavdia G. Ustinov, administrator, ulitsa Tolbukhina, 8, kv. 65, Moscow, U.S.S.R.

[21] Appl. No.: 58,308

[22] Filed: Jul. 17, 1979

[51] Int. Cl.[3] ..... B21C 3/00; B21D 28/00

[52] U.S. Cl. ..... 72/275; 72/340; 72/464; 83/618; 83/694

[58] Field of Search ..... 72/275, 464, 402, 340, 72/324, 254, 255; 83/618, 694

[56] References Cited

U.S. PATENT DOCUMENTS

| | | | |
|---|---|---|---|
| 815,844 | 3/1906 | Lightbody | 72/402 |
| 3,093,897 | 6/1963 | Lemyre et al. | 72/275 |
| 3,370,451 | 2/1968 | Schuetz | 72/402 |
| 3,557,588 | 1/1971 | Catlin et al. | 72/275 |
| 3,875,785 | 4/1975 | Anisimov et al. | 72/340 |

FOREIGN PATENT DOCUMENTS

| | | | |
|---|---|---|---|
| 1452385 | 10/1971 | Fed. Rep. of Germany | 72/255 |
| 1272495 | 4/1972 | United Kingdom | 72/275 |

*Primary Examiner*—Daniel C. Crane
*Attorney, Agent, or Firm*—Fleit & Jacobson

[57] ABSTRACT

The die set for sizing sections includes a movable block and a stationary one, both blocks having cutout portions receiving a sizing die, movable knives and stationary knives forming a jig secured to the stationary block, the jig having made therein communicating channels arranged in accordance with the contour of the section, the jig further having grooves perpendicular to the channels for receiving the movable knives and interacting with the inclined surface of the cutout portion of the movable block.

1 Claim, 5 Drawing Figures

DIE SET FOR SIZING SECTIONS

FIELD OF THE INVENTION

The present invention relates to pressure-working of metals, and, more particularly, to die sets for sizing sections.

It is most expedient to operate a die set for sizing sections constructed in accordance with the present invention in pulsating load hydraulic presses and to use it for sizing sections of various cross-sectional shape made of high-strength steels, titanium, non-ferrous and other alloys.

BACKGROUND OF THE INVENTION

The major task in the manufacture of sections is to provide for a high quality of products of intricate shape, as far as their surface finish and accuracy of every geometrical dimension are concerned, while at the same time providing for a high throughput of the manufacturing process.

At present, sections are predominantly manufactured by sizing in drawing and rolling mills, or else by either mechanical or chemical milling.

However, the methods of sizing products by drawing, by mechanical and chemical milling are characterized by relatively low throughput and more often than not would not provide for turning out the product of adequate quality.

The method of sizing sections by rolling is a high-throughput one; however, it is mainly used for manufacturing products of relatively simple cross-sectional shape.

The most efficient method of producing high-quality sections with sufficiently high throughput is the one of radial swaging in a specific die set in a pulsating load hydraulic press.

The concept of this method is not unlike the working in a mechanical radial-swaging machine; however, in comparison, it offers the better accuracy of the product, this accuracy being unaffected by such characteristics of the machine as the rigidity of its framework and of its effort-transmitting members and assemblies, the presence of clearances and play in the connections, etc.

The structure of a specific die set operable in pulsating load hydraulic presses is disclosed in the US Pat. No. 3,875,785 and GB Patent No. 1,396,252.

The die set includes a stationary block and a movable one, both blocks having in their end faces facing the central axis of the die set cutout portions defining inclined surfaces intersecting along a straight line parallel with the central axis of the die set. The said cutout portions accommodate a sizing die and successively arranged therewith movable and stationary knives for trimming the flanges of sections.

An advantage offered by this die set of the prior art is that it provides for sizing sections in a single pass through the die, i.e. the performance of reducing the thickness of the flanges with simultaneous trimming of their width.

However, the die set of the prior art is of a complicated structure and would not enable the sizing with simultaneous trimming of sections having four and more flanges, e.g. cross-shaped ones, or else flanges extending at different inclination angles relative to one another.

BRIEF DESCRIPTION OF THE INVENTION

It is an object of the present invention to create a die set for sizing sections having an unspecified number of flanges extending at different inclination angles relative to one another, and providing for reducing the thickness of the flanges of the sections with simultaneous trimming thereof to specified dimensions.

This and other objects are attained in a die set for sizing sections, comprising a movable block and a stationary block whose end faces facing the central axis of the die set, having cutout portions defining inclined surfaces intersecting along a straight line parallel with the central axis of the die set, the cutout portions successively accommodating a sizing die and also movable and stationary knives for trimming the flanges of the sections, in which die set, in accordance with the present invention, the stationary knives form a jig secured to the stationary block, the jig having made therein communicating channels arranged in accordance with the contour of the section and also having grooves perpendicular to the channels, accommodating therein the movable knives interacting with the inclined surfaces of the cutout portion of the movable block, to be actuated thereby.

The use of die sets for sizing sections, embodying the present invention, in pulsating load hydraulic presses enables:

to attain a high dimensional accuracy both of the thickness of the flanges of the sections (as high as $\pm 0.1$ to $\pm 0.2$ mm, depending on the thickness value), and of their width;

to attain the high surface finish of the sections, (the surface roughness does not exceed 2.5–0.32 microns depending on the operation ratings);

to step up the productivity about threefold, owing to the increased swaging rate in a single pass, in comparison with the drawing operation, and to super-impose the processes of sizing and trimming the flanges of the sections;

to perform sizing of sections of intricate shape, i.e. having an unspecified number of the flanges and various angles of inclination of the flanges relative to one another;

to perform sizing of thin-wall sections with flanges less than 1.5 mm thick.

BRIEF DESCRIPTION OF APPENDED DRAWINGS

The present invention will be further described in connection with a preferred embodiment thereof, with reference to the accompanying drawings, wherein.

DETAILED DESCRIPTION OF THE INVENTION

Figure 1:
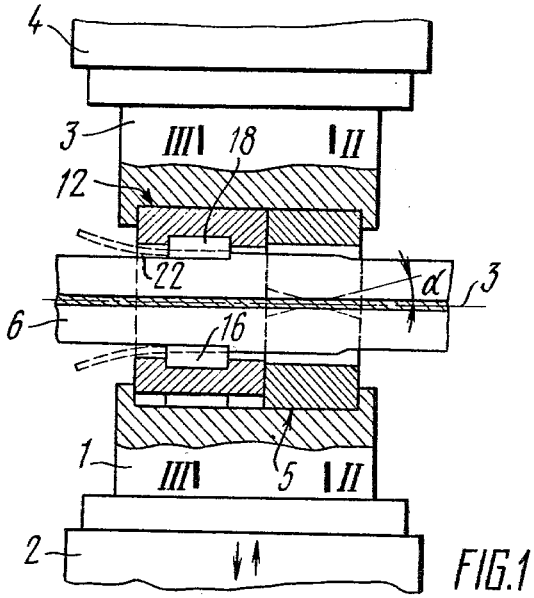
FIG. 1 is a longitudinal sectional view of a die set for sizing cross-shaped sections, embodying the invention.

Referring now in particular to the appended drawings, the die set for sizing sections includes a movable block 1 (FIG. 1) associated with a plunger 2 of the press (not shown in the drawing) for being reciprocated thereby, and a stationary block 3 mounted on a table 4 of the press.

Figure 3:
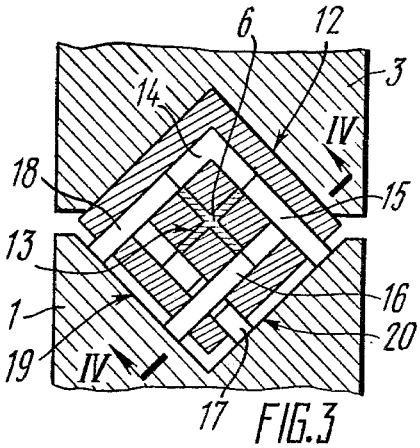
FIG. 3 is a sectional view of the die set for sizing cross-shaped sections, illustrated in FIG. 1, in the area of the accommodation of the knives, in accordance with the invention.
Figure 2:
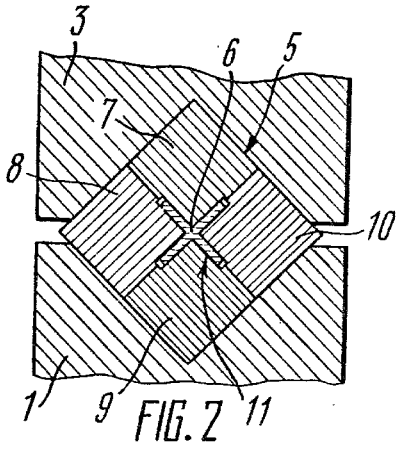
FIG. 2 shows a sectional view of the die set for sizing cross-shaped sections, illustrated in FIG. 1, in the area of the accommodation of the sizing die, in accordance with the invention.

The end faces of these respective blocks 1 and 3, facing the central axis 3' of the die set, have cutout portions accommodating a die 5 for sizing a section 6. The sizing die 5 is made up of components 7 (FIG. 2), 8, 9 and 10 defining approach angles $\alpha$ (FIG. 1) for the section 6. To provide for free sideways flow of the metal in the process of sizing the section 6, the width dimensions of an impression 11 (FIG. 2) are greater than the respective dimensions of the end product. Immediately behind the sizing die 5 there is secured in the cutout portion of the block 3 a jig 12 (FIG. 3) defining stationary knives and having made therein channels 13 for guiding the section 6, the channels corresponding in shape to that of the section 6. At the downstream end of these channels 13 and perpendicularly thereto, there are made in the jig 12 grooves 14 accommodating movable knives 15, 16, 17, 18 having their end faces abutting against the respective inclined surfaces 19, 20 of the cutout portion of the block 1. The cutting edges of these knives extend at cutting angles "$\beta$" (FIG. 4) which are either equal to or less than the approach angles "$\alpha$" of the sizing die 5 for the section. The knives 15 and 16 have slots 21 for facilitated displacement of these knives.

The jig 12 is provided with slots 22 for the disposal of shavings resulting from the trimming of the flanges of the section 6.

The die set for sizing sections, in accordance with the present invention, operates, as follows.

The plunger 2 (FIG. 1) of the pulsating load press is reciprocated jointly with the block 1 carried thereby at a preset oscillation frequency and with a preset amplitude.

Thus, the components 8 (FIG. 2), 9 and 10 of the sizing die 5 and the movable knives 15 (FIG. 3), 16, 17 and 18 are oscillated at the same frequency, the knives 15, 16, 17 and 18 being actuated by the inclined surfaces 19, 20 of the cutout portion of the block 1.

At the same time the section 6 (FIG. 1) is fed lengthwise through the die set and is sized in the die 5 to the required dimensions of the end product.

Figure 4:
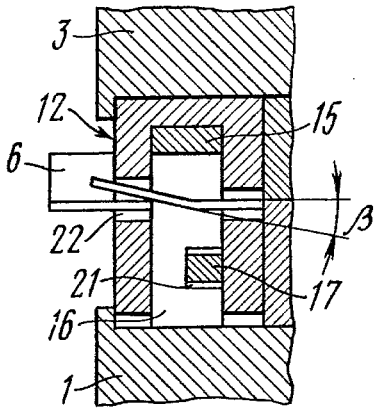
FIG. 4 is a sectional view of the pair of knives illustrated in FIG. 3, in accordance with the invention.

The flow of the displaced metal in the sizing process is both longitudinal of the profile-feeding direction, and lateral, filling up the impression 11 (FIG. 2) of the sizing die 5, which impression, as it has been already stated, has width dimensions in excess of those of the flanges of the end product. Owing to this, the presently disclosed die set can handle blanks with an increased deviation in the flange thickness. The greater is the sideways flow of the surplus metal, the greater is the deviation of the flange thickness of the blank from the nominal size. Upon leaving the sizing die 5, the section 6 enters the channels 13 (FIG. 3) of the jig 12. The lateral sides of the section 6 are then trimmed to size by the movable knives 15, 16, 17 and 18 sliding in the grooves 14 of the jig 12. The trimmed-off metal leaves the die set via the slots 22 (FIG. 4).

To provide for an unobstructed feed of the section 6 through the die set, the cutting angles "$\beta$", as it has been already mentioned, are either equal to or less than the angles "$\alpha$" which are the approach angles of the sizing die 5 (FIG. 1) for the section 6.

Figure 5:
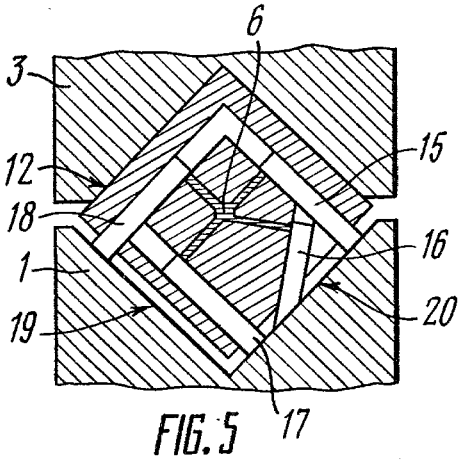
FIG. 5 shows a modification of the arrangement of the knives for sizing sections having flanges extending at different inclination angles, in accordance with the invention.

The structure of the herein disclosed die set also provides for sizing the sections wherein the flanges extend at different angles relative to one another, as it is illustrated in FIG. 5. In this case each movable knife 15, 16, 17 and 18 is arranged in the jig 12 perpendicularly to its respective flange, and the angles of the arrangement of the movable knives 15, 16, 17 and 18 relative to one another correspond to the respective inclination angles of the flanges of the section.

Thus, it has been made clear that a die set constructed in accordance with the present invention, is capable of handling intricate sections with an unspecified number of the flanges which may extend at any inclination angles.

What is claimed is:

1. A die set having a central axis for sizing sections having projecting flanges, comprising:

a movable block and a stationary block each having end faces;

cutout portions formed in said respective end faces of said blocks facing said central axis of said die set, said cutout portions defining inclined surfaces intersecting along a straight line parallel with said central axis of said die set;

a sizing die accommodated in said cutout portions, and movable knives and stationary knives adapted for trimming said flanges of said sections successively accommodated in said cutout portions;

a jig structure defining said stationary knives secured on said stationary block, said jig structure having formed therein channels arranged in accordance with the contour of said section and having formed therein grooves extending perpendicularly to said channels, each said movable knives being accommodated in said grooves for direct interaction with said inclined surfaces of said cutout portion of said movable block to be actuated thereby.

* * * * *